US005497690A

United States Patent [19]

Soupios

[11] Patent Number: 5,497,690

[45] Date of Patent: Mar. 12, 1996

[54] STRING VIBRATION ENHANCER FOR GUITAR-TYPE MUSICAL INSTRUMENTS

[76] Inventor: Charles C. Soupios, 46 Grace Ave. #LC, Great Neck, N.Y. 11021

[21] Appl. No.: 102,644

[22] Filed: Aug. 5, 1993

[51] Int. Cl.[6] ..... G10G 7/02; G10D 3/02; G10D 3/14

[52] U.S. Cl. ..... 84/453; 84/294; 84/312 R

[58] Field of Search ..... 84/298, 299, 307, 84/308, 309, 315, 316, 317, 318, 319, 453, 273, 267, 268, 312 R, 313, 294, 310, 311, 320, 321, 323, 324, 8–12

[56] References Cited

U.S. PATENT DOCUMENTS

| | | | |
|---|---|---|---|
| 2,628,524 | 2/1953 | Van Eps | 84/267 |
| 3,422,715 | 1/1969 | Gambella et al. | 84/307 |
| 3,427,916 | 2/1969 | Fender | 84/273 |
| 3,440,917 | 4/1969 | Lemon | 84/267 |
| 3,623,390 | 11/1971 | Pitt | 84/453 |
| 3,882,754 | 5/1975 | Godley et al. | 84/320 |
| 3,971,287 | 7/1976 | Ito | 84/453 |
| 4,116,107 | 9/1978 | Rickard | 84/267 |
| 4,632,003 | 12/1986 | Kopp | 84/267 |
| 4,667,560 | 5/1987 | Jablonski | 84/310 |
| 5,101,706 | 4/1992 | Kilgore | 84/318 |

*Primary Examiner*—Thomas M. Dougherty
*Assistant Examiner*—Cassandra C. Spyrou

[57] ABSTRACT

A detachable accessory for stringed instruments of the guitar family that utilizes a platform (26) to support individual string contacts (37–42) from a position over an instrument's strings (21–24) near the bridge (20). The contacts (37–42) provide adjustable, curved surfaces for the strings (21–24) to rebound against as they vibrate, causing them to emulate the timbres of other instruments, such as a fretless bass, or a sitar. The device can be attached by double-stick tape or foam, and no alterations are necessary on the instrument.

1 Claim, 5 Drawing Sheets

STRING VIBRATION ENHANCER FOR GUITAR-TYPE MUSICAL INSTRUMENTS

BACKGROUND—FIELD OF INVENTION

This invention relates to guitar-type musical instruments, specifically to a detachable accessory which can adjustably enhance string vibrations to produce a broader range of timbres, emulating fretless bass, sitar, tamboura, and other instruments through mechanical means.

BACKGROUND—DESCRIPTION OF PRIOR ART

Since the electric guitar was first introduced, various accessories have provided greater versatility to guitars and other instruments. For example, tremelos and string benders facillitate popular techniques in which guitarists "bend" notes to create nuances. This involves changing string tensions to alter pitch. Devices of this kind do not affect timbre, however, since stringed instruments usually require electronic enhancement for timbral variations. Using mechanical means to change the timbre of a guitar or bass can be problematic because most physical influences cause string vibrations to diminish.

String muting is probably the earliest known method of mechanically altering string vibrations. Most string mutes are devices that push a soft damping agent (e.g. foam rubber) against the strings of an instrument, near its bridge portion. The purpose of this agent is to constrict the vibrations the strings would normally produce. This shortens the duration of each note and provides a softer, more staccato sound. Muted strings are particularly desireable to reflect a lower amplitude in music.

String mutes can sound very pronounced on certain instruments as stronger contact with the damping agent deepens their effect. They cannot enhance string vibrations, however, simply because they are designed to limit them. Examples of such devices can be found in U.S. Pat. Nos. 3,427,916 to Fender (1969) and 3,440,916 to Lemon (1969). Fender's device was used beneath an instrument's strings; Lemon's mute was used above them. Although these and other designs have improved the function of mutes, few developments (if any) have offered more variety to their sound.

String dampeners provide another type of mute which does not actually limit the string vibrations initiated by a musician's hands. Instead, these devices attach to the top of an instrument's neck to dampen extraneous noises, sympathetic ringing, and harmonic overtones. Essentially, their purpose is to purify all musical notes by eliminating unwanted sounds which can occur near the top of a neck. Examples of string dampeners can be found in U.S. Pat Nos. 2,628,524 (to Van Eps) and 3,971,287 (to Ito).

One other relevant mute covers the sound holes of acoustic instruments. It reduces acoustic volume and limits feedback from amplification. U.S. Pat. No. 4,632,003 to Kopp (1986) also claims that mild changes in tonality can be achieved by means of a mechanical sound gate. This device varies the size of the aperture through which sound vibrations pass. By closing the surface of a guitar's sound board in this manner, a shading of its natural frequencies can occur. Although slight tonal variations are possible, this is a form of sound reduction and not necessarily an improvement over natural qualities. It cannot change an instrument's timbre.

Capodastros are also neck devices, but they differ from string dampeners in that they clamp a guitar's strings at given fret spaces to raise its key tuning. This allows a musician to use simple chord fingerings with open (unfingered) strings in higher keys. Such devices can only raise pitch, however. They cannot improve a guitar's natural qualities. In general, mutes, string dampeners, and capodastros serve their respective purposes without changing an instrument's characteristic sound.

One device of U.S. Pat. No. 5,101,706 to Kilgore (1992) is similar in form to a capo, but its function is to elicit harmonic overtones from a guitar's neck. The Harmonic Bridge can be attached to a neck (like a capo) and positioned directly over any fret where overtones occur. It deploys a row of string contacts above the chosen fret, similar to the way guitarists use a finger's edge across the strings to create harmonics. The concept suggests that this device maintains contact with the strings so both hands can fulfill other functions. Some functions may be restricted, however, since its bulk divides the fingerboard.

Usually, overtones are achieved by lightly touching one or more strings above a specific fret with a finger of one hand, and releasing them simultaneously as the other hand plucks them. This causes a harmonic ringing. Kilgore's invention simulates the contact of fingers from a fixed position on the neck. Once it is in place, however, it prevents the hands from producing overtones in other positions because the device's contact is continuous. In other words, its effect is limited to keys which are relative to its position. Extended use of key modulations would therefore preclude this device since it must be repositioned for most keys.

Another device which has both mechanical and electronic features is found in U.S. Pat. No. 3,882,754 to Godley and Creme (1975). The rotating wheel apparatus of this invention produces sustained sounds by acting as a mechanical adaptation of a violin bow. When the device is placed over a guitar's bridge, a corrugated rubber wheel is aligned with each string. A musician can then depress associated keys to push any number of these wheels downward to contact their respective strings. A continuously rotating shaft then spins each lowered wheel against its string, sustaining its vibration until the key is released and the wheel is retracted.

This apparatus provides timbral variation, but its effect is not adjustable. It has no facility for nuances, and it prevents the use of tremelo devices. Also, because the rotating shaft requires electronics, a large housing is needed which has a high profile on a guitar's bridge. This creates an obstruction for a guitarist's picking hand and causes difficulty in switching from the bowed string effect to common guitar styles. Although the device can be detached and later replaced, its housing and wheels must be realigned with each use. This is not likely during a performance. Switching to a spare guitar is a possible option.

BACKGROUND—RELATED INSTRUMENTS

An improved bridge for the guitar-like instrument of U.S. Pat. No. 3,422,715 to Gambella and Daniels (1969) actually derives from the sitar of India. Sitar bridges are usually hand-made and permanently mounted by craftsmen who are skilled in the art which produces the sitar's delicate sound. The improved bridge can be easily manufactured to provide a similar sound for musicians who play guitar. Guitar strings slap against the bridge's wide surface as they vibrate to cause a sitar-like buzz. This is not considered an accessory, but an integral component of a special instrument. (Its configuration is foreign to most guitars.)

This bridge cannot produce normal guitar sounds because its timbre is fixed, deriving from a non-adjustable, arcuate surface. (The height and intonation of the strings can be adjusted, but these have no effect on timbre.) To use it on a standard guitar would require drilling holes to accommodate the odd size and placement of its mounting screws. Also, since the bridge's intonation depends on a center screw and bias springs, it cannot be used with any tremelo accessories. Such devices would defeat the adjusting hardware. For these reasons, a musician must change instruments whenever common guitar sounds are desired.

All of the related inventions heretofore known suffer from a number of disadvantages:

(a) With the exception of some mutes, none of the aformentioned devices can be adjusted to regulate the effects they produce, and only one can actually change an instrument's characteristic sounds. The rotating wheel apparatus can provide a different timbre to an instrument, but it is not adjustable. It also has no means for creating or accommodating nuances.

(b) The improved sitar bridge cannot change or even produce normal guitar sounds, and it is not useful as a retrofit or an accessory or for most guitars unless they are specially modified.

(c) The rotating wheel apparatus creates an obstruction where guitarists would normally apply picking and strumming techniques. This makes it difficult to switch between modes of play. Options are to remove the device or change guitars.

(d) The rotating wheel apparatus and the improved sitar bridge cannot be used with tremelo devices. They actually prevent the use of very common tools for enhancing guitar techniques.

(e) Muting devices reduce amplitude and limit frequencies. Essentially, they use a form of sound reduction to vary tone.

(f) Kilgore's Harmonic Bridge offers no sound of its own. It simply makes use of a guitar's natural harmonics.

(g) The Harmonic Bridge only works in keys related to its fret position on a guitar's neck. For this reason, it cannot adapt well to music with many key changes because it must be repositioned for most keys.

(h) The Harmonic Bridge hinders the playing of open strings and prevents a musician from creating harmonic sounds on other parts of a guitar's neck. It also obstructs the fingerboard.

OBJECTS AND ADVANTAGES

My current invention mechanically alters the timbre of vibrating strings by contacting each individual string with a separately adjustable, curved surface of wood, metal, or plastic.

Accordingly, several objects and advantages of the present invention are:

(a) to provide an adjustable accessory that can change the timbre of guitar or bass strings to emulate the sounds of a sitar, santur, tamboura, or a fretless bass without diminishing the strings' vibrations or output in any way;

(b) to add unique tonal qualities to a guitar or bass which cannot be produced by a musician's fingers or any techniques;

(c) to provide a sound enhancement device which can be used in all keys without any repositioning or recalibrating;

(d) to provide an accessory which can be used with other devices, such as tremelos, without creating any obstructions to their use or to any techniques that musicians might employ;

(e) to enhance an instrument's capabilities so that its timbre can change to that of a secondary instrument, wherein either of the two sounds can be attained by shifting a cam lever (e.g. a fretted bass can shift to the sounds of a fretless bass);

(f) to reduce the necessity of carrying around secondary instruments for the purpose of achieving variety;

(g) to offer a very inexpensive alternative to electronic, synthesizer-type devices that can change an instrument's sound.

The vibration enhancer provides individual, curved surfaces which an instrument's strings contact with each rebound of their vibrating patterns. Because these surfaces are most effective when positioned for consistent contact, the enhancer works best when mounted over the strings. Although a version of the enhancer with specially shaped surfaces can be used under the strings, it needs extensive calibration for proper functioning. This is because string heights are prone to change as a musician's hand depresses notes in higher positions on the fingerboard. When the contact changes, the effect is reduced in higher registers.

Although it emulates the function and sound of a sitar's bridge, the unit is a detachable accessory that works best in conjunction with bridges and not as a bridge itself. Integration with a guitar's bridge and related hardware could enhance the device's operation with tremelo units as the separate functions of string support and string contact would become interactive. Even as a non-integrated accessory, however, it provides a useful facility to work with common tremelo units. Further objects and advantages of this invention will become apparant from consideration of the related drawings and descriptions.

REFERENCE NUMERALS IN DRAWINGS

Figure 1:
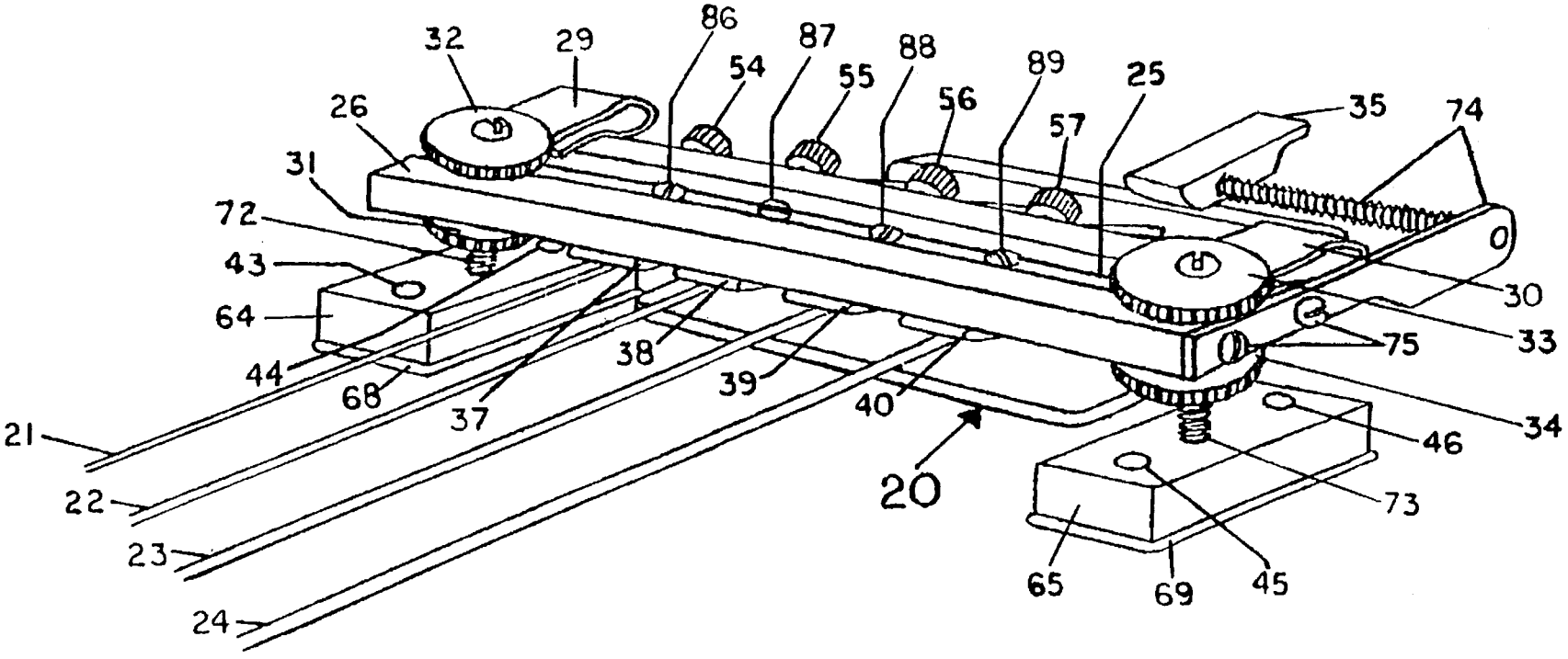
FIG. 1 shows a four string version of a vibration enhancer mounted over a bridge and strings of an electric bass.

20 bass bridge and tailpiece (a combined unit)

21–24 bass strings
25 slotted channel
26 platform with slotted channel (FIG. 1)
27 drilled platform (FIG. 4)
29–30 end springs
31–34 thumb wheels (knurled nuts)
35 cam lever
37–42 metal string contacts
43–46 holes for permanent mounting
48–53 countersunk holes
54–59 thumb screws (knurled)
64–65 mounting blocks
68–69 double-stick foam
72–73 mounting screws
74 mounting hardware
75 screws for mounting hardware
76–81 retainer clips
86–91 clip fastening screws
92 long cam lever

DESCRIPTION OF FIGURES

A typical embodiment of the invention is shown in FIG. 1 where a slotted platform 26 supports four metal string contacts 37–40 (inclusive) and four respective thumb screws 54–57. These are positioned over respective bass strings 21–24 and a combined bass bridge and tailpiece unit 20. The platform 26 is supported and balanced by four thumb wheels 31–34 on two mounting screws 72–73, which are secured by mounting blocks 64–65 and firmly attached to an instrument by pieces of double-stick foam 68–69. Two end springs 29–30 restrain a posterior edge of the platform 26 when a cam lever 35 is raised and the effect is disengaged. When the cam lever 35 is lowered, the contacts 37–40 intersect the strings' vibrating range as the platform 26 is pushed downward by the end springs 29–30.

Figure 2:
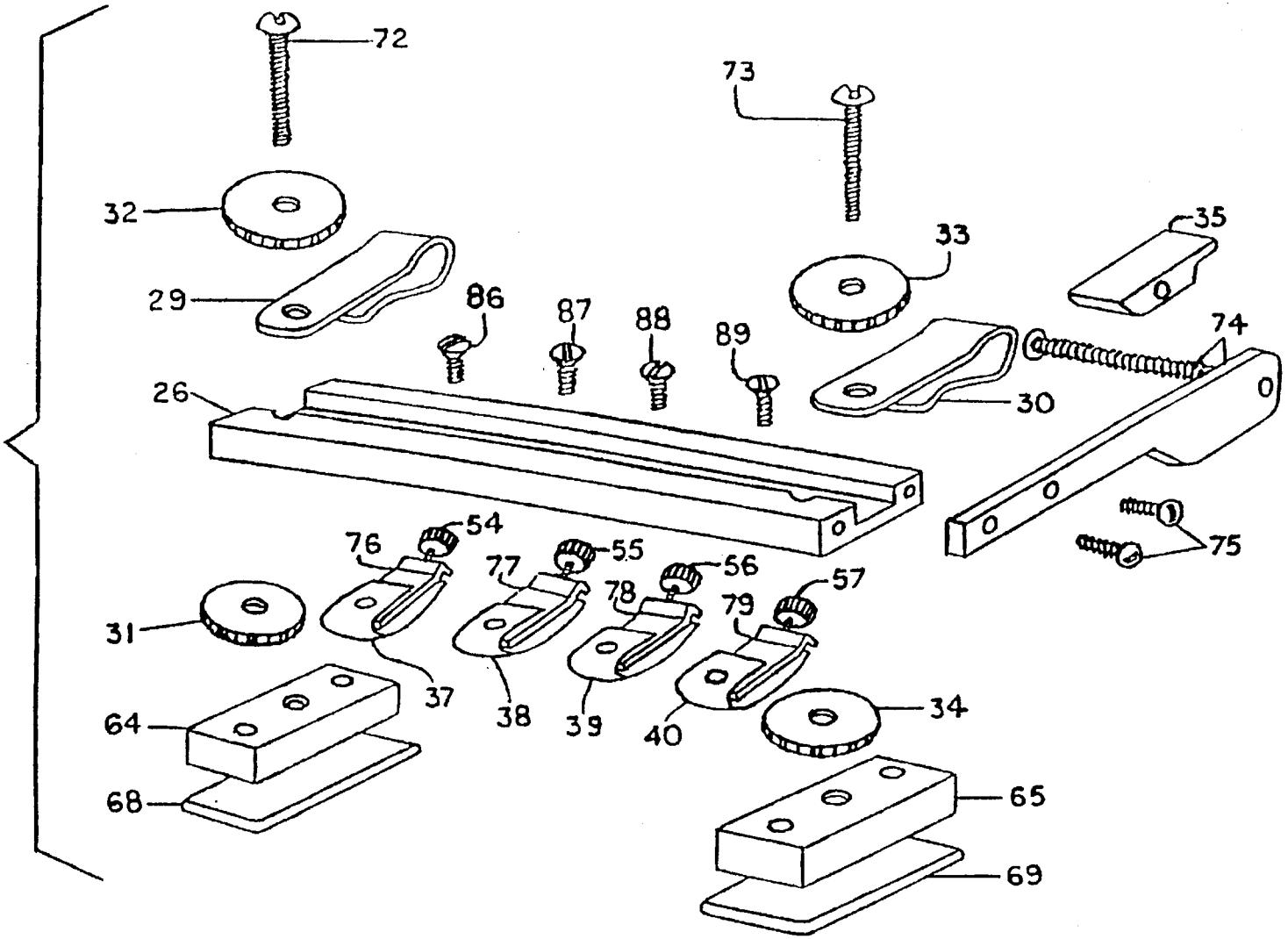
FIG. 2 is an exploded perspective of the unit in FIG. 1.

An exploded view of the invention is illustrated in FIG. 2. For reference purposes, certain parts are illustrated as they would function together. For example, the metal string contacts 37–40 encase retainer clips 76–79, which hold thumb screws 54–57.

Figure 3A:
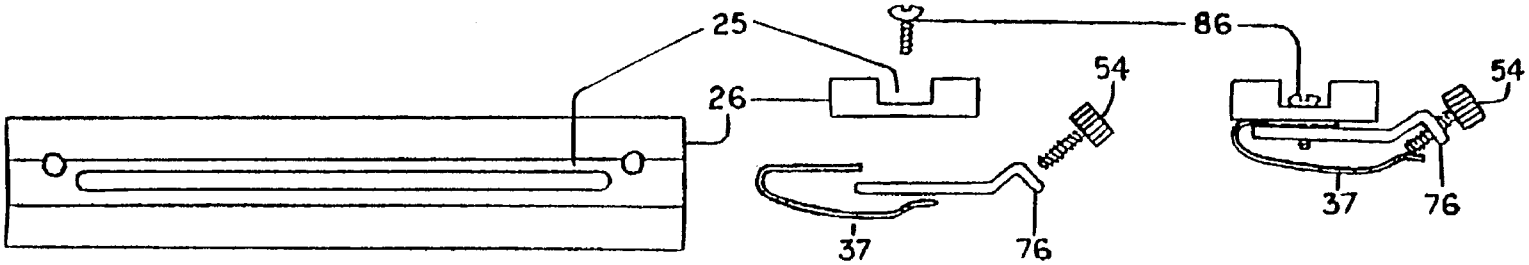
FIG. 3A shows a top view of a platform and side views of a string assembly in pre-assembled and assembled stages.
Figure 3B:
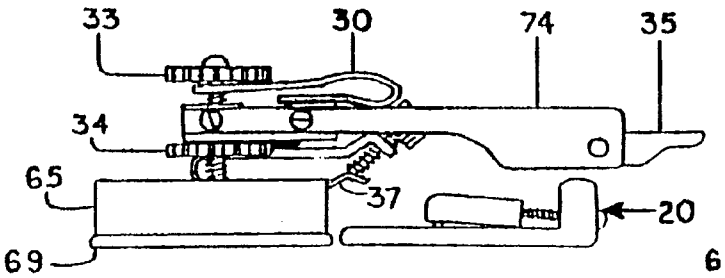
FIG. 3B shows a side view of the unit turned on. (Lever is horizontal)
Figure 3C:
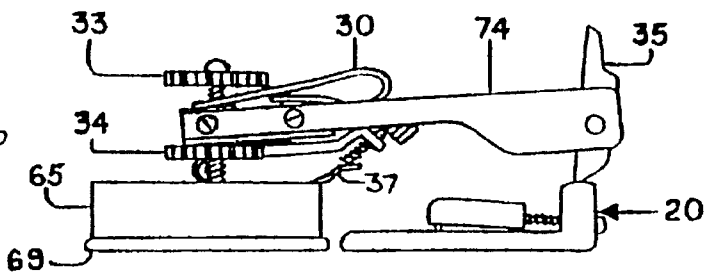
FIG. 3C shows a side view of the unit turned off. (Lever is vertical)

In FIG. 3, retainer clips 76–79 are shown in conjunction with metal string contacts 37–40 and clip fastening screws 86–89, which hold them together through a slotted channel 25. The retainer clips 76–79 also hold adjusting thumb screws 54–57. Adjustments are made as the thumb screws 54–57 are positioned to expand the metal string contacts 37–40, which are actually springs in this embodiment, against their natural resistance. (They are biased to retract back into the platform 26.) This allows for very fine adjustment of their contact surfaces in relation to the range of motion each string has when vibrating.

Also shown in FIG. 3 are the positions of the cam lever 35 and its relationship to the platform's 26 elevation. As stated earlier, when the cam lever 35 is raised (perpendicular to the strings), the posterior edge of the platform 26 is elevated, and the metal string contacts 37–40 are placed out of the strings' vibrating range. When the cam lever 35 is pushed down (parallel to the strings), the platform 26 is lowered, and the contacts 37–40 are placed within the vibrational parameters of the strings.

Figure 4A:
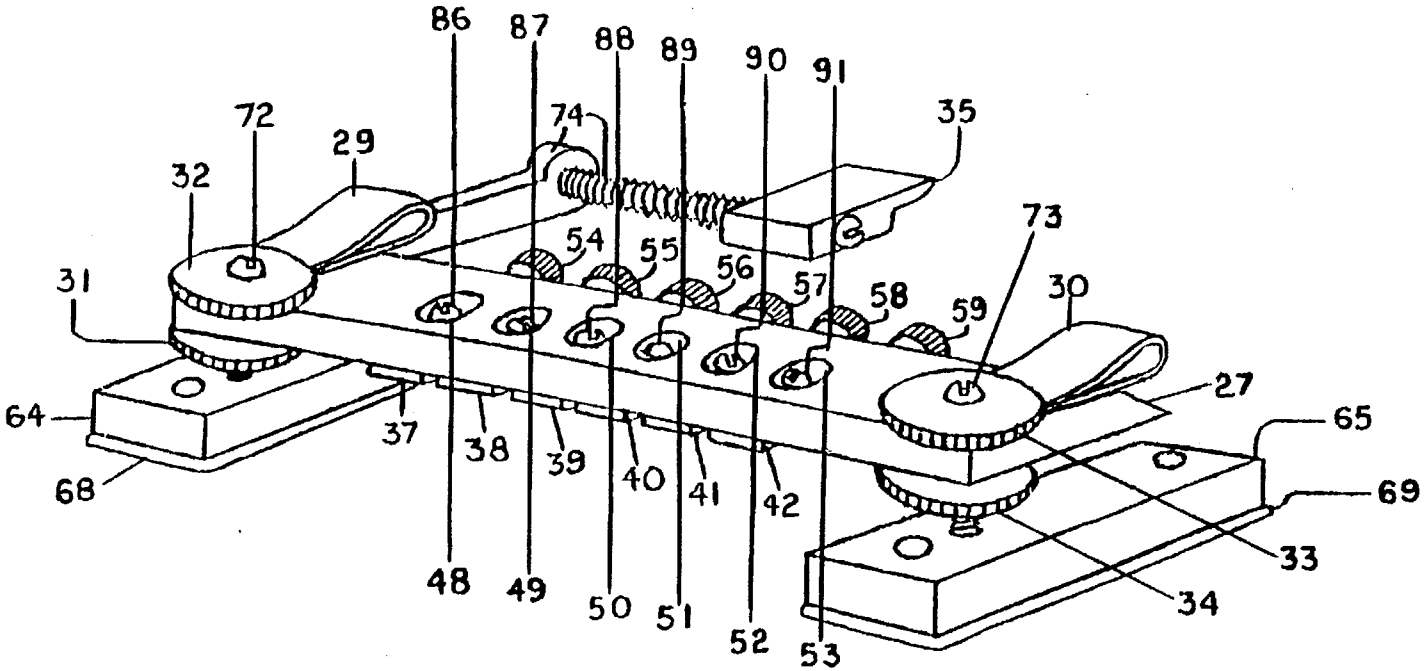
FIG. 4A shows a six string version of a vibration enhancer with a drilled platform and a slanted edge that is threaded for screws.
Figure 4B:
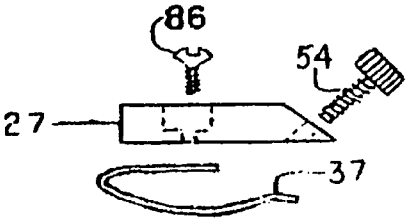
FIG. 4B shows an exploded view of a string contact assembly.
Figure 4C:
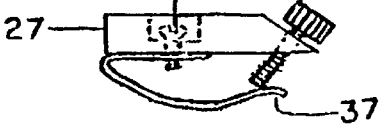
FIG. 4C shows an assembled string contact asembly.
Figure 5A:
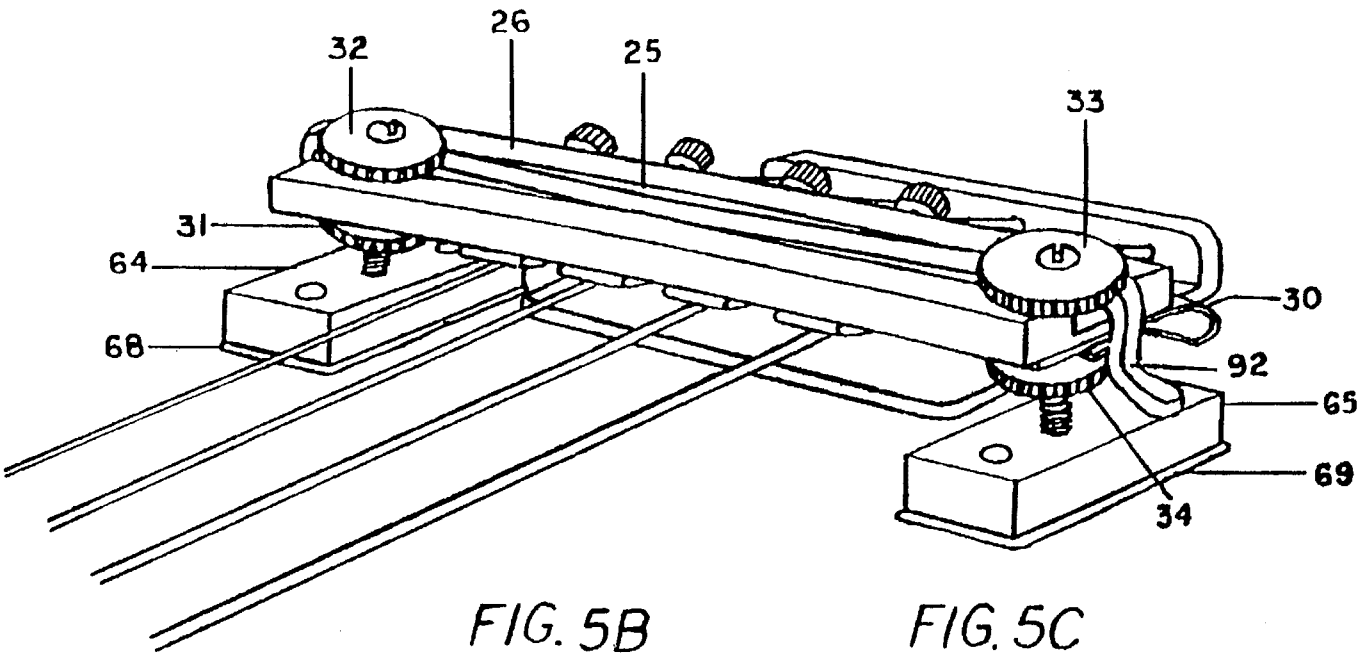
FIG. 5A shows a variation that employs a longer cam lever and end springs that mount beneath the platform.
Figure 5B:
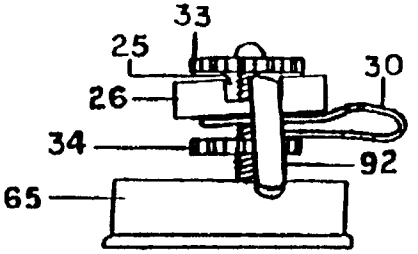
FIG. 5B shows the unit turned off (lever is vertical).
Figure 5C:
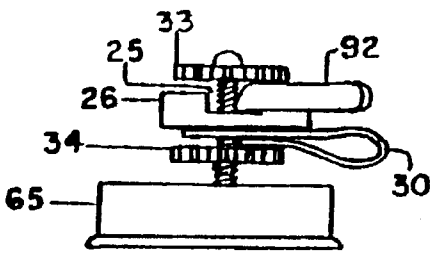
FIG. 5C shows the unit turned on (lever is horizontal).

An embodiment of the invention specifically for guitars is shown in FIG. 4 in which the platform 27 has deep, countersunk holes 48-53 that protect a musician's hand from the screws 86–91. Unlike the previous embodiment, string contacts 37–40 are not used with any retainer clips 76–81 because they are threaded and screwed directly into the platform 27. The thumb screws 54–59 are screwed into a slanted posterior edge of the platform 27 to adjust the string contacts 37–42. The cam lever 35 is the same as in FIG. 1; however, other levers are viable for both units as per FIG. 5. A longer cam lever 92 can be placed in the slotted channel 25 of the first embodiment. In this configuration, the lever 92 pushes the unit toward the strings when it is pulled up. The unit is disengaged when the lever 92 is pushed down. The end springs 29–30 are mounted beneath the platform 26 to accommodate this system.

SUMMARY

Accordingly, the reader will see that the present invention fulfills all of the objectives described herein. The enhancer adjustably contacts an instrument's strings to alter their vibrational patterns and thereby change the instrument's timbre without any muting or sound reduction. As a detachable accessory, it has many advantages, but permanent installation is also possible. It can even be manufactured as part of an instrument's bridge or tailpiece. The device provides an inexpensive new source of sounds for guitar and bass so that musicians will have less reason to carry and use secondary instruments.

Although specific details are used to outline a preferred embodiment of this invention, its scope should not be restricted to one perspective since many configurations are possible. Wood or plastic pieces can be shaped and used to provide the curved surfaces for the string contacts. Screw systems can be used for elevation instead of the preferred cam levers described herein. Platforms can be placed beneath the strings on some instruments. Thus the scope of this invention should not be limited to the details of any embodiment, but instead should be determined by the appended claims and their legal equivalents.

What is claimed is:

1. A vibration altering device for astringed instrument including a bridge and a plurality of strings, each having a vibrating parameter, extending over the bridge; said device comprising:

a platform;

means for detachably mounting said platform to the stringed instrument extending over said strings a selected elevation proximate the bridge and for adjusting the selected elevation of the platform over the string;

a plurality of means for contacting a respective one of the plurality of strings and altering the vibrating parameter thereof; each of said contacting means mounted on said platform and comprising a curved surface located in a resiliently biased position for intersecting the respective one of the plurality of strings;

means for adjusting the resiliently biased position of said curved surface of each of said contacting means; said adjusting means comprising a plurality of adjusting screws each of said adjusting screws mounted on said platform adjacent the curved surface of one of said contacting means;

means for raising and lowering the platform for selective engagement of said contacting means with the plurality of strings thereby altering the vibration parameters thereof; said raising and lowering means comprising a cam mechanism.

* * * * *